US007722397B2

(12) United States Patent
Schleith

(10) Patent No.: US 7,722,397 B2
(45) Date of Patent: May 25, 2010

(54) PLUG CONNECTOR

(75) Inventor: Ralf Schleith, Weil am Rhein (DE)

(73) Assignee: Multi-Holding AG, Allschwil (CH)

( * ) Notice: Subject to any disclaimer, the term of this patent is extended or adjusted under 35 U.S.C. 154(b) by 0 days.

(21) Appl. No.: 12/300,320

(22) PCT Filed: May 2, 2007

(86) PCT No.: PCT/CH2007/000215

§ 371 (c)(1),
(2), (4) Date: Nov. 10, 2008

(87) PCT Pub. No.: WO2007/128152

PCT Pub. Date: Nov. 15, 2007

(65) Prior Publication Data

US 2009/0124117 A1 May 14, 2009

(30) Foreign Application Priority Data

May 8, 2006 (CH) ..... 740/06

(51) Int. Cl.
*H01R 13/40* (2006.01)

(52) U.S. Cl. ..... 439/595; 439/733.1

(58) Field of Classification Search ..... 439/586, 439/592, 593, 594, 595, 597, 598, 599, 600, 439/601, 603, 752, 733.1, 744, 751, 752.5
See application file for complete search history.

(56) References Cited

U.S. PATENT DOCUMENTS 3,259,871 A * 7/1966 Chandler ..... 439/598
3,812,447 A * 5/1974 Eifler et al. ..... 439/595
3,845,452 A * 10/1974 Eifler ..... 439/595
3,845,453 A * 10/1974 Hemmer ..... 439/578
4,214,802 A * 7/1980 Otani et al. ..... 439/275
4,387,945 A * 6/1983 MacAvoy ..... 439/595
4,443,048 A * 4/1984 Moist, Jr. ..... 439/599
4,544,220 A * 10/1985 Aiello et al. ..... 439/594
4,560,219 A * 12/1985 Chapelot ..... 439/587
4,606,596 A * 8/1986 Whiting et al. ..... 439/465
4,632,482 A * 12/1986 Punako et al. ..... 439/587
4,655,525 A * 4/1987 Hunt et al. ..... 439/599

(Continued)

FOREIGN PATENT DOCUMENTS

GB 969827 A 9/1964

(Continued)

*Primary Examiner*—Ross N Gushi
(74) *Attorney, Agent, or Firm*—Browdy and Neimark, PLLC

(57) ABSTRACT

The invention relates to a plug connector (10) for the detachable connection of a number of cable pairs (97, 98) with a conductor cross-section of more than 10 $mm^2$, in particular, for the supply of the welding current in welding robots, wherein individual contact elements (52, 60), with a conducting connection to the cables (97, 98), may be plugged into an insulated plug housing (11) with a clipping action and are detachably held in the plug housing (11) or terminal housing (12), the clipping action of the contact elements (52, 60) in the housings (11, 12) being achieved by an elastic deformation of the housings (11, 12). Manipulation is facilitated in that the housing (11, 12) is made from a material of such a hardness that the plugging in and exchange of contact elements can be achieved without the use of tools.

29 Claims, 8 Drawing Sheets

U.S. PATENT DOCUMENTS

| | | | | | |
|---|---|---|---|---|---|
| 4,708,662 | A | * | 11/1987 | Klein | 439/353 |
| 4,865,558 | A | * | 9/1989 | Stoner | 439/246 |
| 4,941,847 | A | * | 7/1990 | Welsh | 439/595 |
| 5,158,479 | A | * | 10/1992 | Mouissie | 439/589 |
| 5,460,549 | A | * | 10/1995 | Muzslay | 439/733.1 |
| 5,885,113 | A | * | 3/1999 | Bricaud | 439/733.1 |
| 5,934,927 | A | * | 8/1999 | Nagai | 439/397 |
| 5,954,546 | A | * | 9/1999 | Fink et al. | 439/752 |
| 6,000,966 | A | * | 12/1999 | Dechanteloup et al. | 439/595 |
| 6,419,519 | B1 | | 7/2002 | Young | |
| 6,821,160 | B2 | * | 11/2004 | Fink et al. | 439/701 |
| 6,923,670 | B2 | * | 8/2005 | Holmes et al. | 439/368 |
| 6,923,685 | B2 | * | 8/2005 | Holmes et al. | 439/660 |
| 6,994,598 | B2 | * | 2/2006 | Holmes et al. | 439/752.5 |
| 7,056,138 | B2 | * | 6/2006 | Lewis et al. | 439/296 |
| 7,347,745 | B1 | * | 3/2008 | Raudenbush et al. | 439/752 |
| 7,413,478 | B2 | * | 8/2008 | Kleinschmidt et al. | 439/686 |
| 7,563,134 | B2 | * | 7/2009 | Kim, II | 439/578 |
| 2004/0077205 | A1 | * | 4/2004 | Holmes et al. | 439/347 |
| 2004/0102091 | A1 | * | 5/2004 | Jazowski et al. | 439/606 |
| 2004/0175981 | A1 | * | 9/2004 | Holmes et al. | 439/352 |
| 2005/0106950 | A1 | * | 5/2005 | Fink et al. | 439/752 |
| 2006/0099844 | A1 | * | 5/2006 | Holmes et al. | 439/368 |
| 2006/0183375 | A1 | * | 8/2006 | Benham | 439/595 |
| 2007/0218778 | A1 | * | 9/2007 | Lappoehn | 439/751 |
| 2009/0130902 | A1 | * | 5/2009 | Hall et al. | 439/595 |

FOREIGN PATENT DOCUMENTS

| | | | |
|---|---|---|---|
| GB | 2144929 | A | 3/1985 |
| WO | 2004017466 | A | 2/2004 |

* cited by examiner

Fig.3
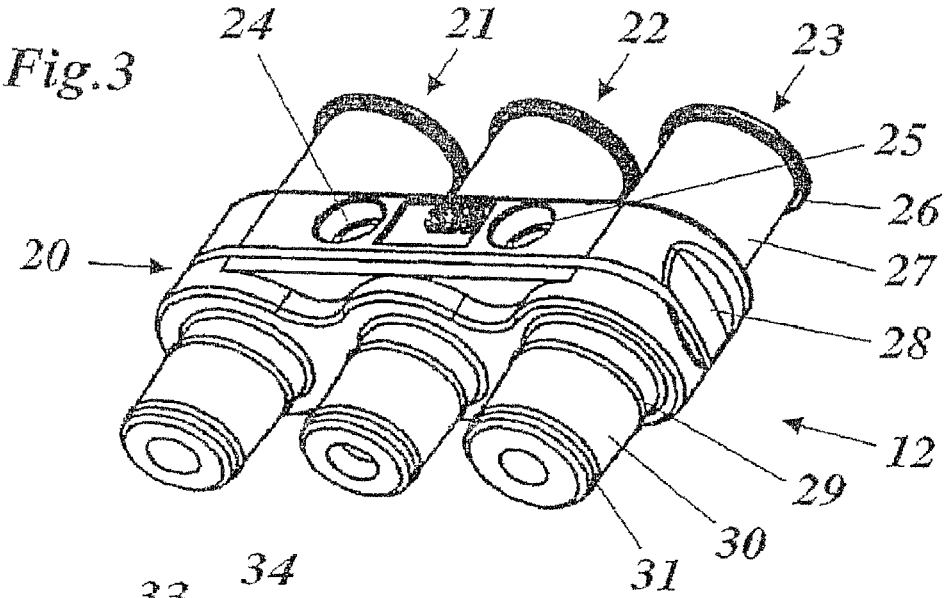
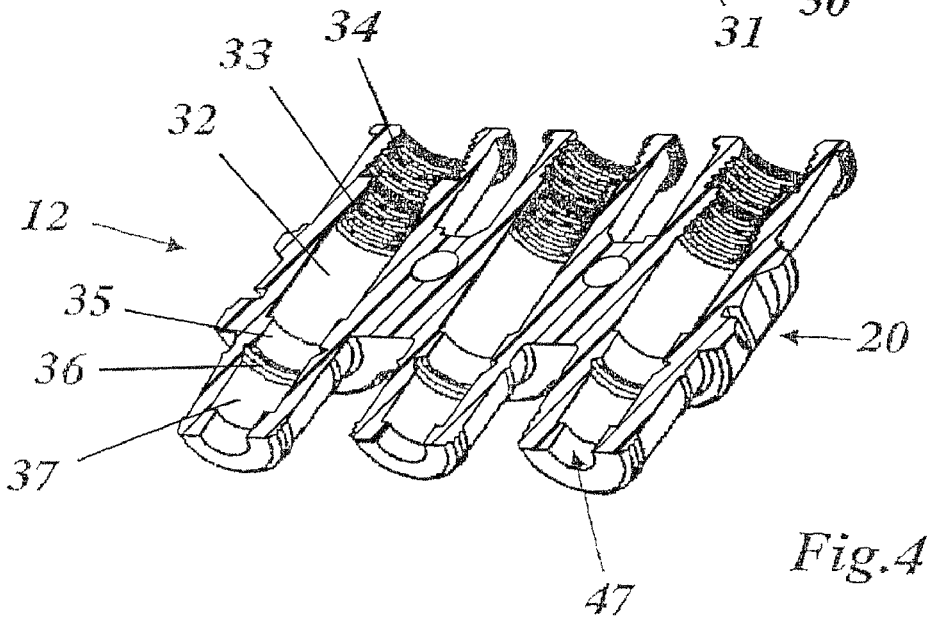
Fig.4

PLUG CONNECTOR

TECHNICAL FIELD

The present invention relates to the field of electrical plug-type connections. It relates to a plug-type connection in accordance with the preamble of claim 1.

PRIOR ART

In robot technology, in particular in industrial welding robots, comparatively high currents in the region of 100 A or more need to be guided from the base of the robots along the robot arm to the apparatuses fitted at the end of the robot arm (welding tools etc.). For this purpose, wiring with the corresponding conductor cross sections (typically 10-50 $mm^2$) are used which are guided along the robot arm and are equipped with corresponding plug-type connections at the joints (in particular at the base and at the end of the arm).

For the application with welding robots, the applicant already markets plug-type connections from the TSB/TSS series (primary circuit plug-type connectors for welding transformers), in which individual contacts in the form of sockets and corresponding pins are electrically connected to the cable ends, from which the insulation has been stripped, by means of a screw-type or crimping connection and are then introduced into corresponding (cylindrical) insulating housings (see in this regard the catalog MC Roboticline 07.2001 (ex Ho7b), 2001; pages 18, 19 and 31). In accordance with the assembly instructions MA 200, special tools are required for this purpose in order to press the individual contacts, which are resting on the cable ends, into the bores provided for this purpose in the insulating housings and to press them out again, if necessary, in the event of repair work (pages 41-44 of the abovementioned catalog).

The known plug-type connections for the primary circuit of welding transformers in the welding robots sector have proven to be successful in practice. However, special tools (pin introduction tool, pin removal tool, socket introduction tool, socket removal tool etc.) are required for introducing and removing the individual contacts, and these tools not only need to be kept at the assembly/dismantling location, but also require special handling of the insulating housings when they are used. Since, in the case of welding robots, the associated cables are subject to pulse-like mechanical loads owing to the pulse-like welding currents and the associated magnetic fields, the cables need to be replaced more often during continuous operation of the robots in an industrial environment. In this case it is desirable for such a replacement to be capable of being carried out simply and quickly and also under restricted space conditions.

Furthermore, in the case of new robot types it is now practice to lay the supply and control cables or cable harnesses, which until now have been guided on the outside along the robot arms, in the interior of the arms in order to prevent possible collisions between the cable harnesses and objects arranged in the vicinity of the swiveling range of the robot and therefore also to simplify programming. By laying the cables in the interior of the robot arm, simplified assembly/dismantling of the plug-type connections becomes even more important under restricted conditions as well.

Furthermore, the plug-type connections should be as tight against one another as possible in a simple manner, both in the region of contact-making in the plugged-in state and in the region of the cable entry point (protection rating IP67).

Furthermore it is desirable to be able to secure the plug-type connection in the plugged-in state against unintentionally becoming unplugged in a simple manner and to be able to fix the plug-type connection at the use location in a simple manner.

DESCRIPTION OF THE INVENTION

The object of the invention is to specify a plug-type connection for the described use which avoids the disadvantages of previous plug-type connections and can be assembled and dismantled simply and quickly without special aids and also under restricted spatial conditions.

The object is achieved by the entirety of the features of claim 1. The essence of the invention consists in, in the case of the plug-type connection according to the invention, individual contact elements, which are conductively connected to the cables, being plugged into an insulating plug housing and/or an insulating socket housing so as to latch in and being held replaceably in the plug housing and socket housing, respectively, wherein the latching-in of the contact elements in the housings is achieved by elastic deformation of the housings, and wherein the housings are made from a material with a hardness which makes it possible for the contact elements to be plugged in and replaced without the aid of tools. The material of the housings is therefore "soft" enough for the individual contacts, which are located at the cable ends and are equipped with latching apparatuses, to be capable of being pressed into the bores provided for this purpose in the housings and possibly also withdrawn again without the use of special tools, i.e. only by hand, counter to a certain resistance. The "softness" of the material in this case depends on the design of the latching mechanism which also determines the level of elastic deformation required.

In accordance with a configuration of the invention, the plug housing and/or the socket housing are designed to be integral and are made from a thermoplastic elastomer (TPE).

A further configuration of the invention is characterized by the fact that the contact elements are arranged in the plug housing and/or the socket housing parallel next to one another in one plane, and in that in each case three contact elements are arranged next to one another in the housings.

With respect to the mechanical stability and sealtightness, it is particularly advantageous if cable sleeves for accommodating the ends of the cables connected to the contact elements are arranged on the plug housing and/or socket housing, and if releasable fastening means are provided, by means of which the cables can be fixed in the cable sleeves.

Preferably, the fastening means each comprise a cable strain-relief clamp, which fixedly clamps the cables in the cable sleeves as a result of external pressure on the cable sleeves, wherein the cable strain-relief clamps each comprise an upper part and a lower part, which surround the cable sleeves on opposite sides and can be connected to one another, and wherein the cable sleeves are in the form of hollow cylinders which are arranged next to one another parallel at a distance, and the upper part and the lower part of the cable strain-relief clamps are each in the form of a bar, which extends transversely over the cable sleeves and is equipped, on the side facing the cable sleeves, with cutouts so as to conform to the cable sleeves.

In particular, the upper and lower parts of the cable strain-relief clamps have mutually aligned bores in order for them to be connected to one another, wherein the upper and lower parts of the cable strain-relief clamps are connected to one another by means of fastening screws, which extend through the bores, and exert external pressure on the cable sleeves.

Another configuration is characterized by the fact that the cable strain-relief clamps and therefore the entire plug-type connection is fixedly screwed by means of the fastening screws on a base.

A further configuration of the invention is characterized by the fact that the plug housing and the socket housing can be secured against the plug-type connection being pulled apart from one another by means of a securing clip, which, in the plugged-together state of the plug-type connection, can be inserted into the housings, wherein the securing clip preferably comprises an elongate base plate, from which pins protrude in perpendicular fashion in one direction at the ends, and through-bores, into which the securing clip with the pins can be plugged, are provided in the housings.

It is particularly favorable for the application if the pins are provided with slots at the free ends and have latching heads, with which they latch in at the outlet of the through-bores, and if recessed grips are integrally formed on the securing clip, by means of which recessed grips the securing clip can be drawn out of the housings without the use of a tool. In particular, the securing clip is designed to be integral and is produced as an injection molded part from a plastic.

The cable strain-relief clamps are preferably produced from a plastic, in particular a fiber-reinforced polyamide.

In order to achieve sealing and clamping which is improved further still, it is advantageous if the cable sleeves taper slightly conically inwards towards the outlet, and if the cutouts are likewise slightly conical.

In accordance with a further configuration of the invention, slightly conical socket receptacle sections, which are positioned next to one another at a distance and parallel and receive the contact sockets of the female contact elements, are arranged on the socket housing; corresponding contact protection means are arranged on the plug housing which receives the socket receptacle sections if the plug-type connection has been plugged together. Preferably in this case sealing beads are formed on the outside on the socket receptacle sections in order to increase the sealtightness.

Another configuration is characterized by the fact that the housings each have connection chambers for receiving the contact elements, that in each case one latching tab with a latching groove, which is positioned behind the latter in the plug-in direction, is formed in the connection chambers, and that in each case one holding groove and a latching collar is provided on the contact elements so as to interact with the latching tab and the latching groove. In order to facilitate the insertion process, in this case the latching collar has a sloping flank on the plug-in side.

In order to further improve handling, recessed grips for drawing the housings apart from one another can be formed on the housings.

In order to make it possible to use the plug-type connection in cables with different outer diameters, it is advantageous if the cable sleeves are split into two sections, which are arranged one behind the other in the plug-in direction, wherein the inner diameter of the section which is positioned further towards the outside is greater than the inner diameter of the other section.

In accordance with another configuration, the upper part and the lower part of the cable strain-relief clamps are guided with respect to one another by means of guide pins, wherein, preferably, the guide pins are coded for the purpose of clear orientation of the parts with respect to one another.

Furthermore, it is advantageous if mutually fitting coding elements are provided on the strain-relief clamp and on the associated plug or socket housing and ensure a clear orientation of the strain-relief clamp with respect to the associated plug or socket housing.

BRIEF EXPLANATION OF THE FIGURES

The invention will be explained in more detail below with reference to exemplary embodiments in connection with the drawing, in which:

FIG. 3 shows a perspective illustration of the socket housing of the plug-type connection from FIG. 1;

FIG. 4 shows a perspective illustration of the longitudinal section through the socket housing from FIG. 3;

APPROACHES FOR IMPLEMENTING THE INVENTION

Figure 1:
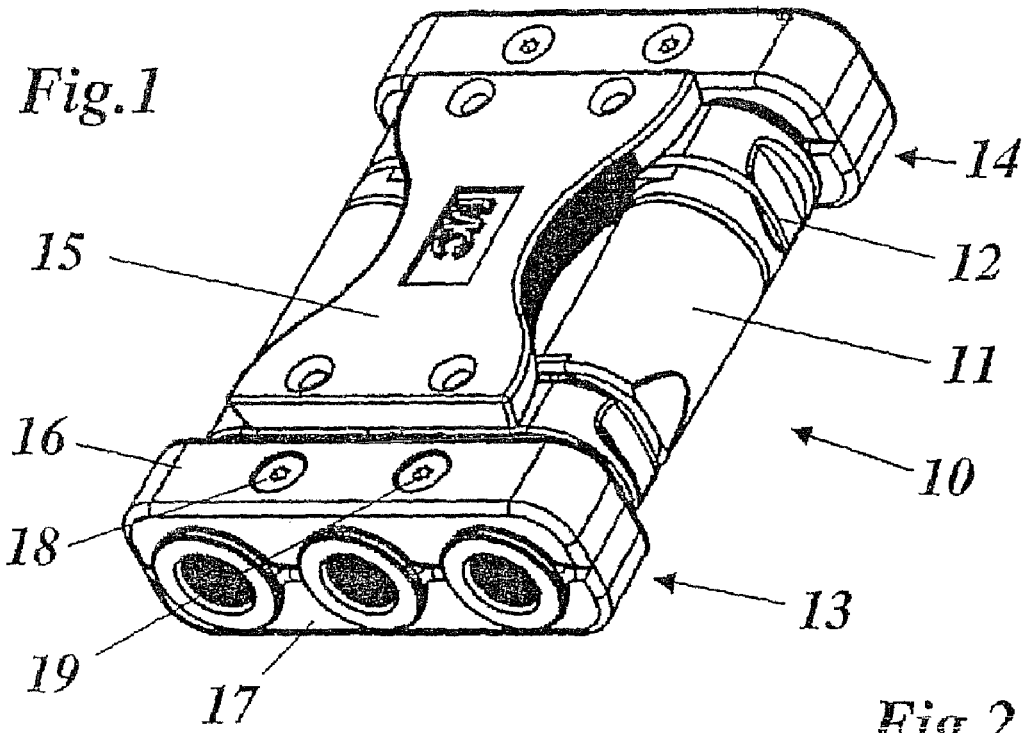
FIG. 1 shows a perspective illustration of a plugged-together plug-type connection (without cables) in accordance with a preferred exemplary embodiment of the invention.
Figure 2:
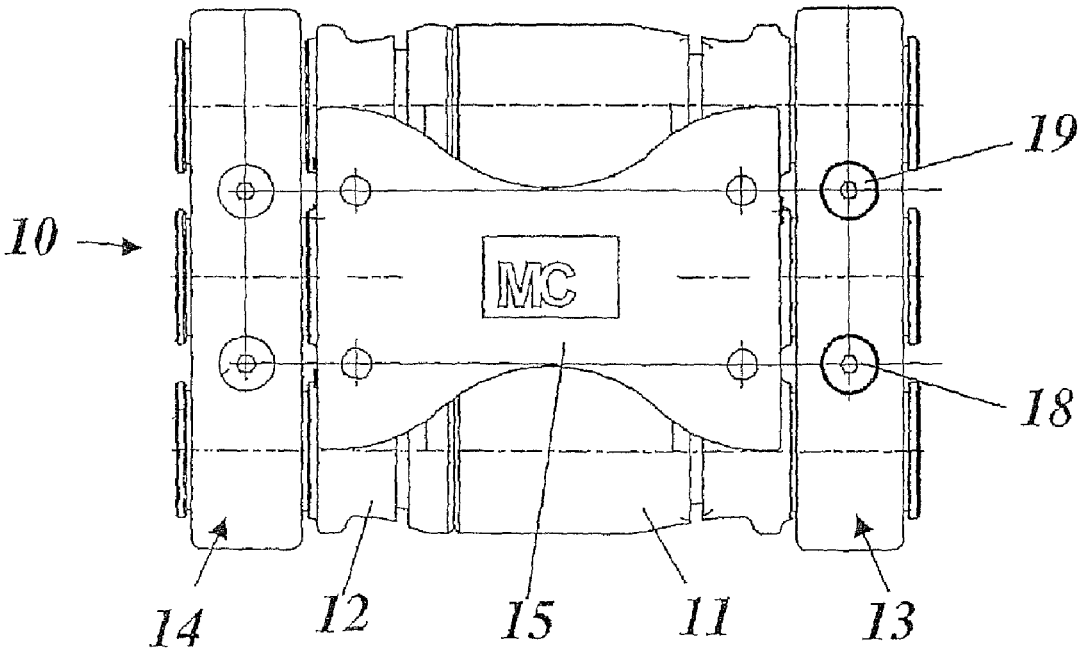
FIG. 2 shows the plug-type connection from FIG. 1 in a plan view from above.

FIG. 1 reproduces a perspective illustration of a plugged-together plug-type connection (without the cables connected to the contact elements) in accordance with a preferred exemplary embodiment of the invention. In the example, the plug-type connection 10 is designed for connecting three cable pairs, with the connection of two cable pairs or more than three cable pairs likewise being conceivable. In the example, the plug-type connection 10 comprises an insulating plug housing 11 (illustrated individually in FIGS. 5 and 6), an insulating socket housing 12 (illustrated individually in FIGS. 3 and 4), two cable strain-relief clamps 13 and 14, and a securing clip 15, which secures the plugged-together housings 11, 12 against unintentionally becoming unplugged. All of parts 11, . . . , 15 of the plug-type connection 10 are made from a plastic. The housings 11, 12 are preferably produced from a thermoplastic elastomer (TPE), whose hardness is set such that the contact elements shown in FIGS. 7 and 8 can be pressed into the housings 11, 12, but also withdrawn again (on the cables) without special aids (tools). FIG. 2 shows the plugged-together plug-type connection 10 in a plan view from above.

Figure 12:
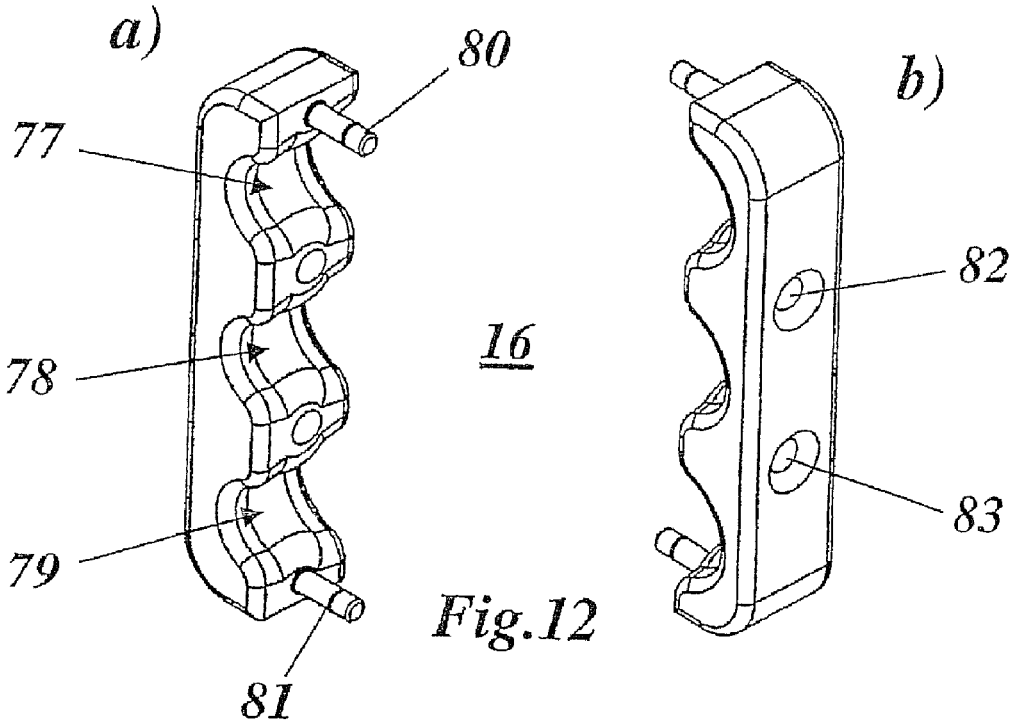
FIG. 12 shows, in two subfigures (a) and (b), a perspective front and rear view of the upper part of the cable strain-relief clamp from FIG. 1.
Figure 13:
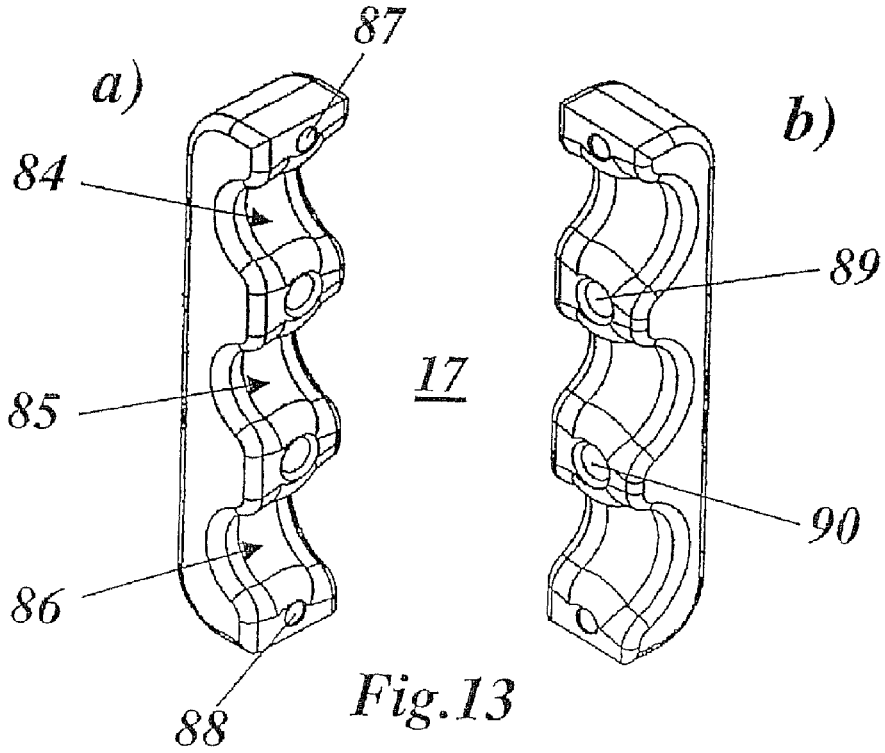
FIG. 13 shows, in two subfigures (a) and (b), a perspective front and rear view of the lower part of the cable strain-relief clamp from FIG. 1.

The cable strain-relief clamps 13, 14 each comprise an upper part (FIG. 12) and a lower part (FIG. 13), which can be connected to one another by means of fastening screws 18, 19 in order to exert the necessary external pressure on the parts of the housing lying therebetween (cable sleeves 27 and 45, respectively). The cable strain-relief clamps 13, 14 are preferably produced from a fiber-reinforced polyamide in order to achieve the required mechanical strength.

Figure 10:
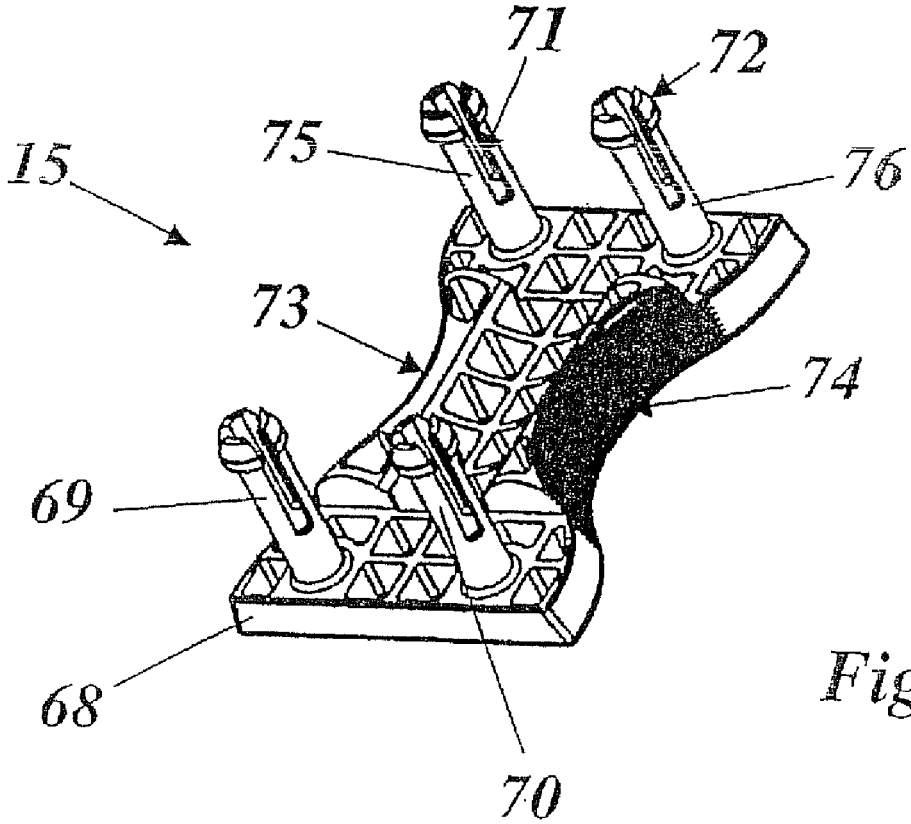
FIG. 10 shows the securing clip from FIG. 9 in a perspective illustration, viewed from below.

The socket housing 12 illustrated in FIGS. 3 and 4 is designed to be integral. It comprises a central part 20, which extends transversely with respect to the plug-in direction and through which two vertical through-bores 24 and 25 run next to one another, into which bores the securing clip 15 can be plugged with two of its four pins (69, 70, 75, 76 in FIG. 10). Three socket chambers 21, . . . , 23, which extend parallel to one another in the plug-in direction and lie in one plane, are integrally formed on the central part 20, wherein in each case one connection chamber 32, which ends at the front in a socket receptacle section 30 and at the rear in a cable sleeve 27, runs through said socket chambers 21, . . . , 23. Recessed grips 28 are integrally formed at the lateral ends of the central part 20, on which recessed grips 28 the hand can be placed when unplugging the plug-type connection 10. The arrangement of the individual plug-type connections in one plane means a particularly flat design of the plug-type connection, which is advantageous when integrating the associated cables in the robots.

The individually shaped cable sleeves 27, which are spaced apart from one other, are designed to be cylindrical on the outside. On the inside, they are split into two sections 33, 34, which are arranged behind one another in the plug-in direction, wherein the outer section 34 has a greater inner diameter than the section 33 lying further inwards. The two sections 33, 34 with the different inner diameters make it possible to receive cables with different outer diameters (different sheath designs) given the same conductor cross section. It is thus conceivable, for example, to connect cables with a conductor cross section of 35 $mm^2$ which have an outer diameter of between 11 and 17 mm. The same metal parts (contact elements 52, 60 from FIGS. 7 and 8) are used for all of these cables. In the sections 33, 34, the cable sleeves 27 are each tapered slightly conically towards the outside in terms of their inner diameter and have concentric ribbing on the inner wall, which ribbing assists both the mechanical fixing and the sealing of the cable in the cable sleeve 27. In each case one peripheral bead 26 is integrally formed at the outer ends of the cable sleeves 27, which peripheral bead 26 ensures the fit of the cable strain-relief clamp 14 on the cable sleeves 27.

Figure 5:
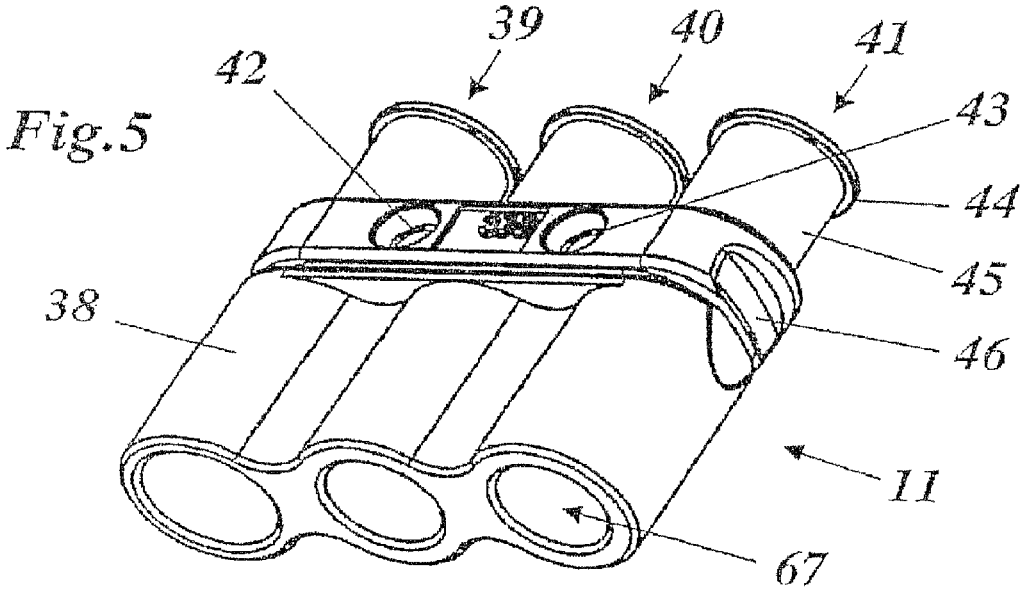
FIG. 5 shows a perspective illustration of the plug housing of the plug-type connection from FIG. 1.
Figure 7:
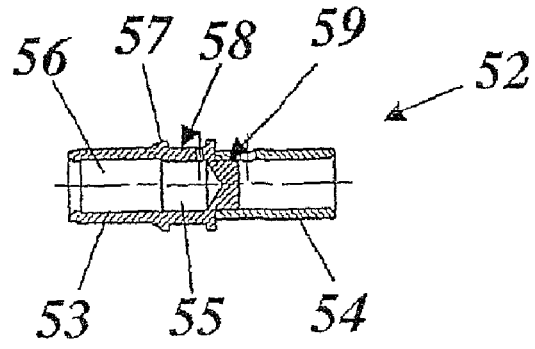
FIG. 7 shows the longitudinal section through a female contact element, which can be inserted removably into the socket housing from FIG. 3.

The individually shaped socket receptacle sections 30, which are spaced apart from one another, taper slightly conically towards the front on the outside. When the plug-type connection 10 is plugged together, they are plugged into corresponding contact protection means 67 in the plug housing 11 (FIG. 5). The socket receptacle sections 30 receive the contact sockets (53) of the female contact elements 52 (FIG. 7). Two sealing beads 29, 31, which are used for sealing the plug-type connection between the two housings 11 and 12, are formed on the socket receptacle sections 30 in such a way that they are spaced apart axially on the outside.

The connection chambers 32 in the socket housing 12 are provided for receiving the female contact elements 52 shown in FIG. 7. For this purpose, in each case one inwardly projecting latching tab 35 with a latching groove 36, which lies behind said latching tab 35 in the plug-in direction, is formed in the connection chambers 32, which latching tabs interact with a matching holding groove 58 and a matching latching collar 57 on the contact element 52. In order to make it easier to plug the contact element 52 into the connection chamber 32 of the socket housing 12, the latching collar 57 of the contact element 52 has a sloping flank on the plug-in side. In order to make it easier for the contact element 52 to be withdrawn from the connection chamber 32, the side walls of the holding groove 58 can be designed to be slightly sloping.

Figure 16:
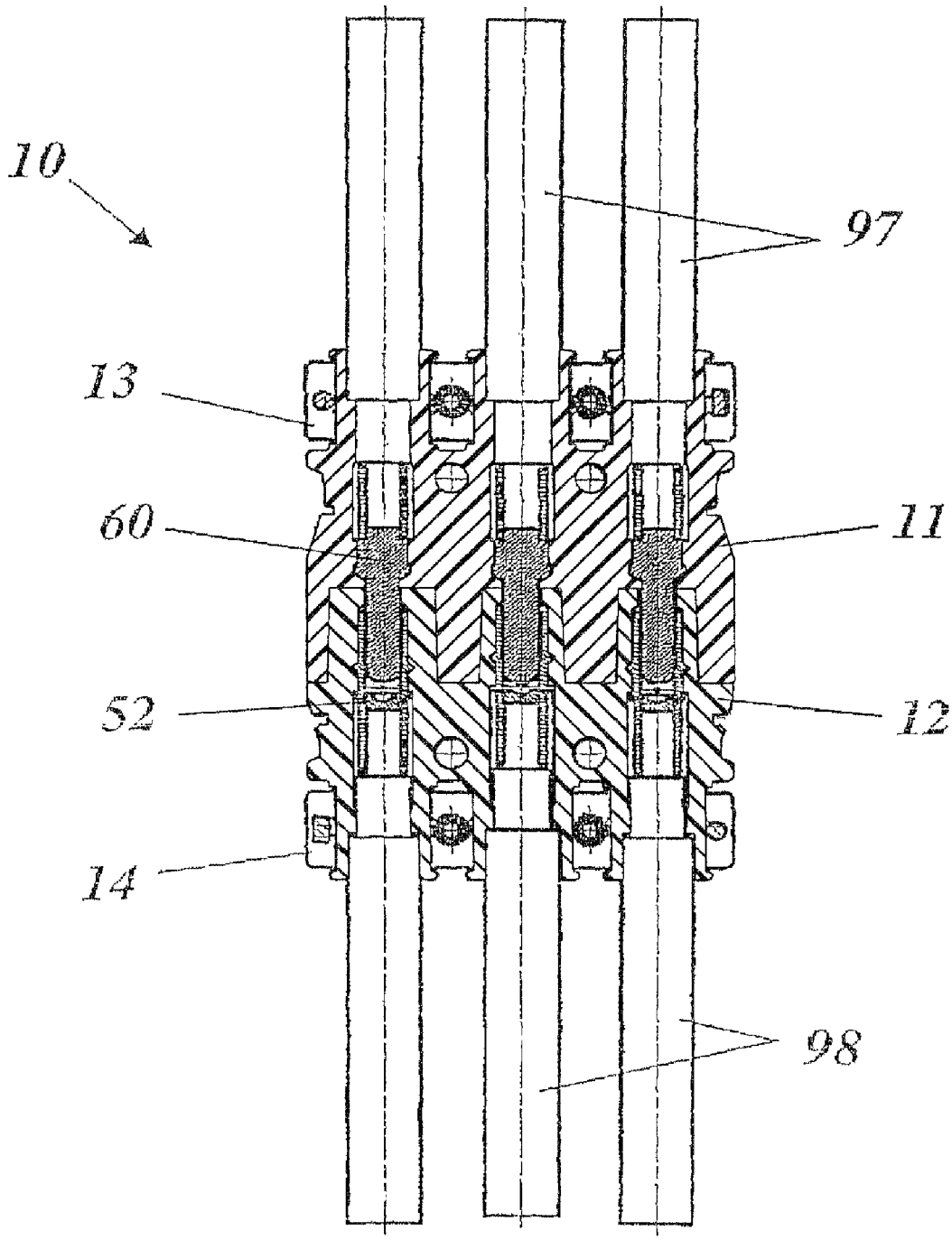
FIG. 16 shows a longitudinal section through a completely assembled and plugged-together plug-type connection in accordance with a preferred exemplary embodiment of the invention.

If the contact element 52 with the contact socket 53 leading is introduced into the connection chamber 32 from the rear through the cable sleeve 27, it can initially be pushed in, without any considerable resistance, until it hits the rear rim of the latching tab 35 with the latching collar 57. When it is pushed in further assisted by the sloping flank on the latching collar 57, the latching tab 35 is pressed elastically radially outwards until it snaps back completely into the holding groove 58 behind the latching collar 57 if, at the same time, the latching collar 57 latches into the latching groove 36. The contact socket 53 of the contact element 52 is then resting in the socket area 37 provided for this purpose of the socket housing 12 and is covered at the front by a contact protection means 47 so as to prevent unintentional contact being made. If the contact element 52 has reached this end position, the cable reaches with its sheath into the cable sleeve 27 and can be fixed there by means of the cable strain-relief clamp 14 (cables 97, 98 in FIG. 16).

Figure 6:
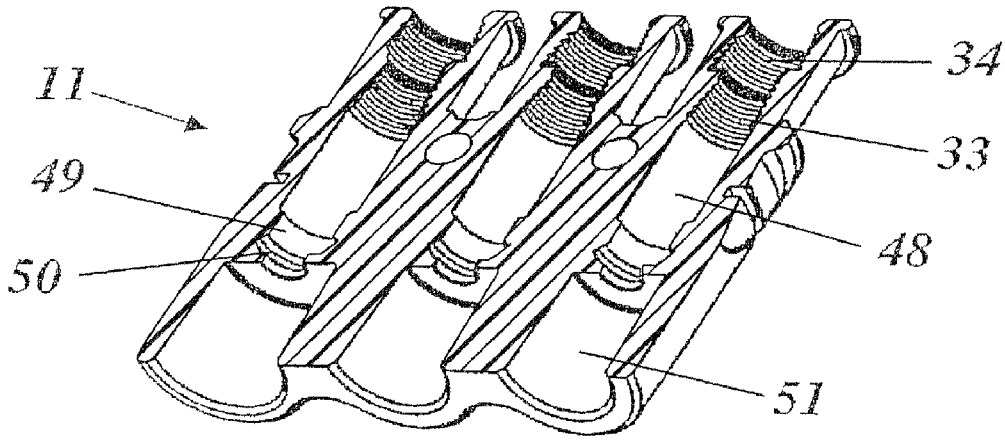
FIG. 6 shows a perspective illustration of the longitudinal section through the plug housing from FIG. 5.

Similar conditions prevail in the case of the plug housing 11 shown in FIGS. 5 and 6. The plug housing 11 is designed to be integral. It comprises three plug chambers 39, . . . , 41, which extend parallel to one another in the plug-in direction and lie in one plane and through which in each case one connection chamber 48 runs, which ends at the front in a common plug receptacle section 38 and at the rear in each case in a cable sleeve 45. Likewise recessed grips 46 are integrally formed at the lateral ends of the plug housing 11, with it being possible for the hand to be placed on said recessed grips 46 when the plug-type connection 10 is unplugged.

The individually shaped cable sleeves 45, which are spaced apart from one another, are designed to be cylindrical on the outside on the socket housing 12 in the same way as the cable sleeves 27 and on the inside are split into two sections 33, 34, which are arranged behind one another in the plug-in direction, with concentric ribbing. Likewise, a peripheral bead 44, which secures the fit of the cable strain-relief clamp 13 on the cable sleeve 45, is integrally formed on the outer ends of the cable sleeves 45.

Figure 8:
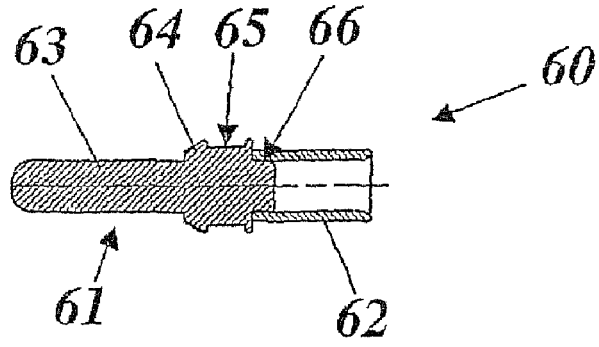
FIG. 8 shows the longitudinal section through a male contact element, which can be inserted removably into the plug housing from FIG. 5.

The connection chambers 48 in the plug housing 11 are provided for receiving the male contact elements 60 shown in FIG. 8. For this purpose, in each case one inwardly projecting latching tab 49 with a latching groove 50 lying behind it in the plug-in direction is formed in the connection chambers 48, which latching tabs interact with a matching holding groove 65 and a matching latching collar 64 on the contact element 60. In order to make it easier to plug the contact element 60 into the connection chamber 48 of the plug housing 11, the latching collar 64 of the contact element 60 also has a sloping flank on the plug-in side. In order to make it easier to withdraw the contact element 60 from the connection chamber 48, the side walls of the holding groove 65 can also be designed to be slightly sloping here.

If the contact element 60 with the pin 63 leading is inserted into the connection chamber 48 from the rear through the cable sleeve 45, initially it can be pushed in, without any considerable resistance, until it hits the rear rim of the latching tab 49 with the latching collar 64. When it is pushed in further assisted by the sloping flank on the latching collar 64, the latching tab 49 is pressed elastically radially outwards until it snaps back completely into the holding groove 65 behind the latching collar 64 if, at the same time, the latching collar 64 latches into the latching groove 50. The pin 63 of the contact element 60 then protrudes into the plug area 51 of the plug housing 11 provided for this purpose and is surrounded by the socket receptacle section 30 of the socket housing 12 if the plug-type connection 10 has been plugged together. If the contact element 60 has reached this end position, the cable reaches with its sheath in the cable sleeve 45 and can be fixed there by means of the cable strain-relief clamp 13. The slightly conical embodiment of the plug area 51 and the socket receptacle section 30 and the sealing beads 29, 31 ensures that, in the plugged-in state, a sealtightness in accordance with IP67 is achieved at this point (see FIG. 16).

The preferred female contact element 52 shown in FIG. 7 comprises, in a manner known per se, a contact socket 53 with a blind bore 55 and a shoulder 59, onto which a press bush 54 is pushed and fixedly soldered. The cable end with the exposed conductor is pushed into the press bush 54 and compressed. An annular groove 56 for receiving a multi-contact contact lamination, which is bent in annular fashion, is provided in the blind bore 55, wherein the multi-contact contact lamination makes the electrical contact with the inserted pin 63 of the male contact element 60 from FIG. 8. The male contact element 60 preferably comprises a contact plug 61 with a shoulder 66 arranged at the rear, onto which a press bush 62 is pushed and fixedly soldered. The cable is in this case fitted in the same way as in the case of the contact element 52 in FIG. 7.

As has already been mentioned further above, the cable strain-relief clamps 13, 14 each comprise an upper part 16 (FIG. 12) and a lower part 17 (FIG. 13), which surround the cable sleeves 27 and 45, respectively, on opposite sides and can be connected to one another. The upper part 16 and the lower part 17 of the cable strain-relief clamps 13, 14 are each in the form of a bar, which extends transversely over the cable sleeves 27, 45 and is equipped, on the side facing the cable sleeves 27, 45, with approximately semicylindrical cutouts 77, . . . , 79 and 84, . . . , 86, respectively, so as to conform to the cable sleeves 27, 45. The cutouts 77, . . . , 79 and 84, . . . , 86, respectively, are preferably designed to be slightly conical in order to achieve improved clamping and sealtightness in accordance with IP67 in interaction with the slightly conical sections 33, 34 in the cable sleeves 27, 45.

The upper and lower parts 16, 17 of the cable strain-relief clamps 13, 14 have mutually aligned bores 82, 83 and 89, 90, respectively, so as to connect them to one another. Fastening screws 18, 19 are plugged through these bores 82, 83 and 89, 90, respectively, in order to connect the two parts 16, 17 to one another and to exert external pressure on the cable sleeves 27, 45. For this purpose, corresponding nuts can be arranged on the opposite side. However, it is also possible to fixedly screw the cable strain-relief clamps 13, 14 and therefore the entire plug-type connection 10 on a base (mounting plate or the like) by means of the fastening screws 18, 19. In addition, in order to align the clamp parts, guide pins 80, 81 can be provided on the upper part 16 and/or lower part 17, which guide pins 80, 81 enter, in guiding fashion, corresponding bores 87, 88 on the lower part 17 and/or upper part 16.

Figure 11:
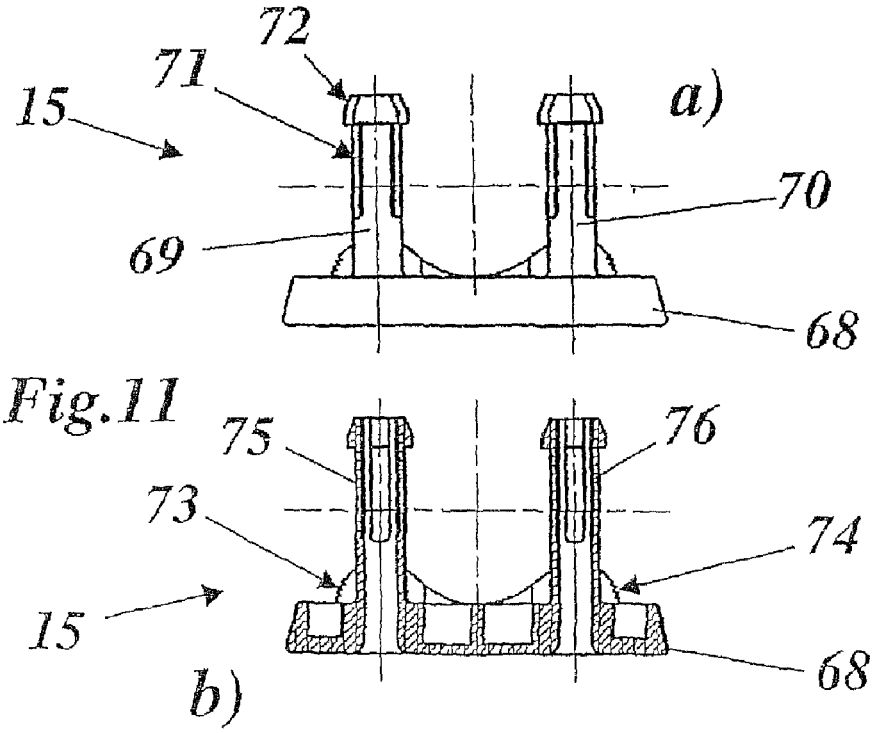
FIG. 11 shows, in two subfigures (a) and (b), the side view of the securing clip from FIG. 9 and the section in a sectional plane passing through two pins.
Figure 9:
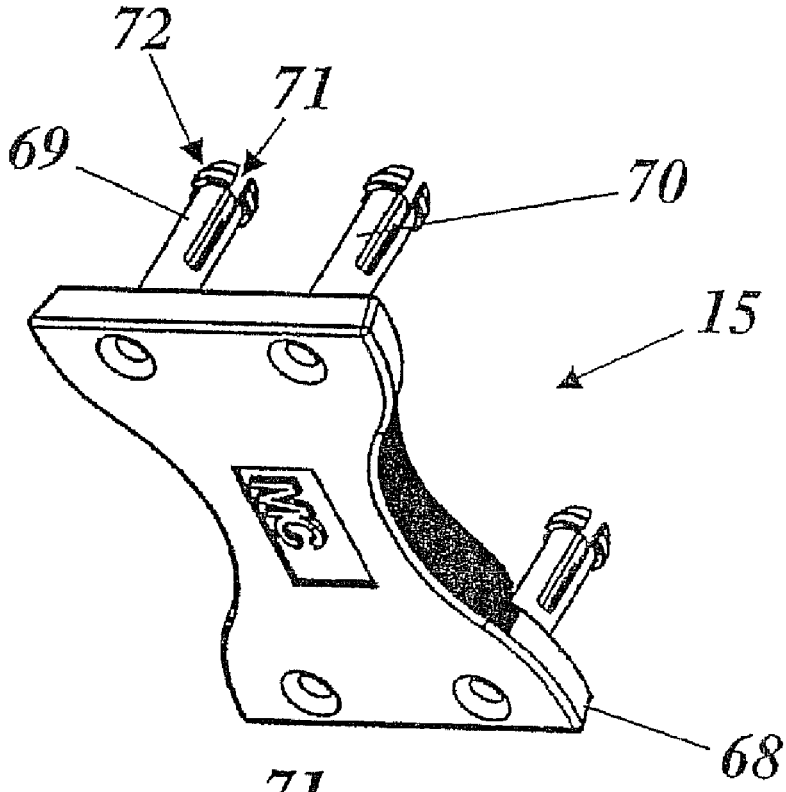
FIG. 9 shows a perspective illustration, viewed from above, of the securing clip from FIG. 1 for securing the plugged-together plug-type connection from FIG. 1.

It is furthermore possible to secure the plug housing 11 and the socket housing 12 by means of a securing clip 15 which can be plugged in so as to prevent the plug-type connection 10 from being drawn apart. The securing clip suitable for this purpose (FIGS. 9-11) comprises an elongate base plate 68, from which pins 69, 70 and 75, 76 protrude perpendicularly at the ends in one direction in pairs. Corresponding vertical through-bores 24, 25 and 42, 43, respectively, are provided in the housings 11, 12, into which through-bores the securing clip 15 can be plugged with the pins 69, 70 and 75, 76, respectively.

The pins 69, 70, 75, 76 are provided with slots at their free ends and have latching heads, with which they latch in at the outlet of the through-bores 24, 25 and 42, 43, respectively. Advantageously, recessed grips 73, 74 are integrally formed laterally on the securing clip 15, by means of which recessed grips 73, 74 the securing clip 15 can be withdrawn from the housings 11, 12 without the use of a tool. The securing clip 15 is preferably designed to be integral and is produced as an injection-molded part from a plastic.

Figure 14:
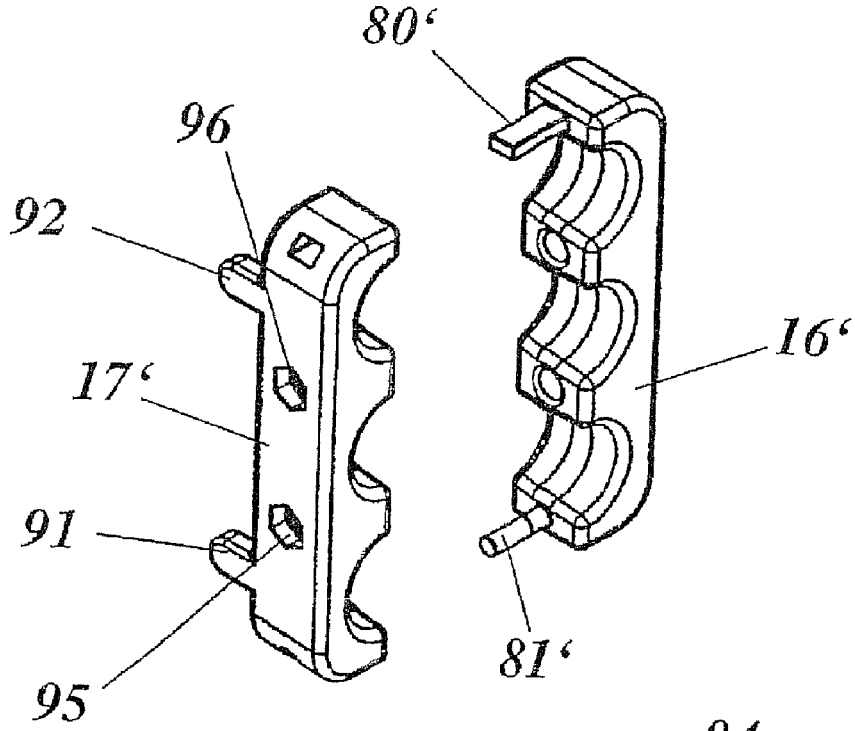
FIG. 14 shows the upper and lower part of a strain-relief clamp similar to FIGS. 12 and 13 with coded guide pins and coding elements for interaction with the plug housing from FIG. 15.
Figure 15:
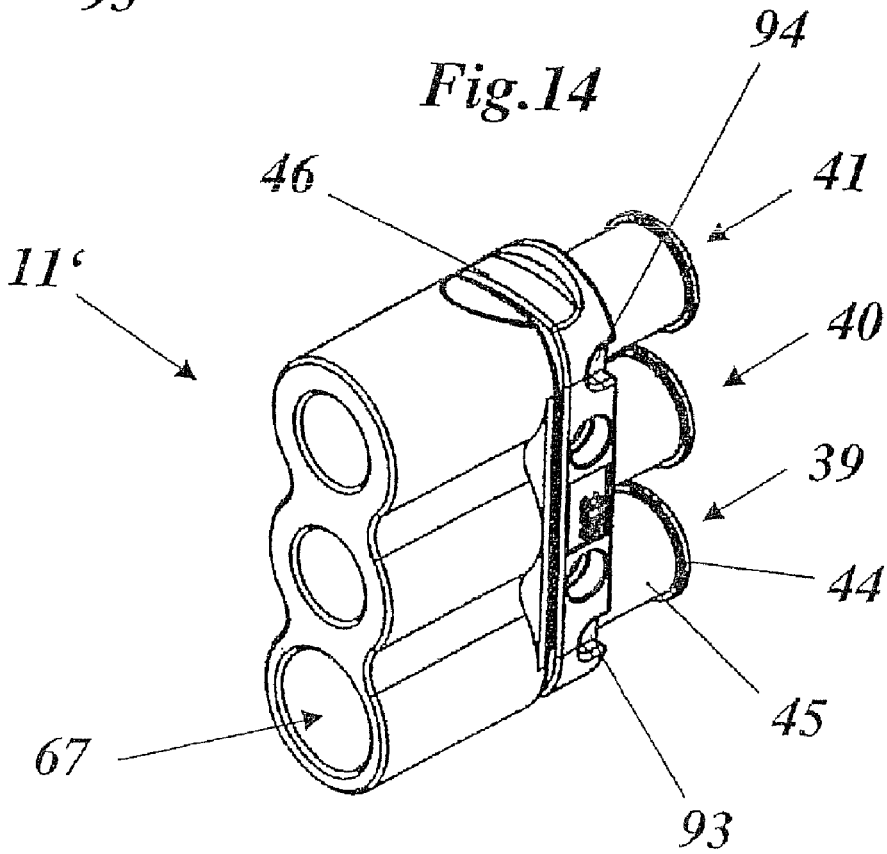
FIG. 15 shows a perspective illustration of a plug housing similar to that in FIG. 5 with additional coding elements for interaction with the strain-relief clamp from FIG. 14.

In order to ensure clear assignment of the two parts of the strain-relief clamps with respect to one another and furthermore to make it possible to clearly orientate the strain-relief clamps relative to the plug housing or socket housing, coding means can be arranged on the parts. Examples of such coding means are illustrated in FIGS. 14 and 15. The cable strain-relief clamp from FIG. 14 has, similarly to FIGS. 12 and 13, an upper part 16' and a lower part 17', which together form the clamp. Two hexagonal openings 95, 96 can be seen on the upper side of the lower part 17', which hexagonal openings 95, 96 receive corresponding nuts if the two parts are screwed to one another. The two parts 16', 17' are guided with respect to one another by guide pins 80', 81', which in this example are coded: the guide pin 80' on the upper part 16' has a rectangular cross section, which corresponds to that of a bore in the lower part 17' with a rectangular cross section. The guide pin 81' on the upper part 16', in contrast, has a circular cross section, which corresponds to that of a bore in the lower part 17' with a circular cross section. Other codings are also conceivable.

Furthermore, laterally protruding, tab-shaped coding elements 91, 92 are integrally formed on the lower part 17' of the strain-relief clamp, which coding elements 91, 92 enter corresponding recesses (coding elements 93, 94) in the plug housing 11' in FIG. 15 if the strain-relief clamp is fastened on the plug housing 11' in the correct orientation. This ensures that the strain-relief clamps clamp the cables ending in the plug-type connection in the desired manner. Furthermore, it can be seen on the plug housing 11' in FIG. 15 that the contact protection means 67 can have different opening diameters, which make it possible for there to be clear assignment between the two plug-type connectors during the insertion process.

Overall, the functional principle of the plug-type connection according to the invention can be summarized as follows:

The plug-type connection is designed, for example, for a cable cross section of 35 $mm^2$. The cables may be three fixed cable types, whose outer diameter may vary from approximately 11 mm to approximately 17 mm. The cables are pressed against one and the same metal part (contact element). Then the cables together with the metal part (contact element) are plugged into the insulating housing from the rear through the cable sleeve without the use of a tool until they noticeably latch into it.

If all of the three contacts have been latched in, the cable strain-relief clamp can be plugged onto the cable sleeves. Now the cable strain-relief clamp can be screwed against a mounting plate with the corresponding threads by means of two (M5) screws. With this strain relief, the required holding force of the cables in the insulation is achieved. Furthermore, the protection rating IP67 on the cable sleeve is achieved thereby.

Furthermore, the entire plug-type connection is held and locked on the mounting plate via the screws in the cable strain relief.

For dismantling the device, the complete sequence is conducted in reverse order.

LIST OF REFERENCE SYMBOLS

10 Plug-type connection
11, 11' Plug housing
12 Socket housing
13, 14 Cable strain-relief clamp
15 Securing clip
16, 16' Upper part (cable strain-relief clamp)
17, 17' Lower part (cable strain-relief clamp)
18, 19 Fastening screw
20 Central part (socket housing)
21, . . . , 23 Socket chamber (socket housing)
24, 25 Through-bore (for securing clip)
26, 44 Peripheral bead
27, 45 Cable sleeve
28, 46 Recessed grip
29, 31 Sealing bead
30 Socket receptacle section
32, 48 Connection chamber
33, 34 Section (cable receptacle)
35, 49 Latching tab
36, 50 Latching groove
37 Socket area
38 Plug receptacle section
39, . . . , 41 Plug chamber (plug housing)
42, 43 Through-bore (for securing clip)
47, 67 Contact protection means
51 Plug area
52 Contact element (female)
53 Contact socket
54, 62 Press bush
55 Blind bore
56 Groove (contact lamination)
57, 64 Latching collar
58, 65 Holding groove
59, 66 Shoulder
60 Contact element (male)
61 Contact plug
63 Pin
68 Base plate
69, 70 Pin
71 Slot
72 Latching head
73, 74 Recessed grip
75, 76 Pin
77, . . . , 79 Cutout
80, 81 Guide pin
80', 81' Guide pin (coded)
82, 83 Bore
84, . . . , 86 Cutout
87, 88 Bore
89, 90 Bore
91, 92 Coding element (strain-relief clamp)
93, 94 Coding element (plug housing)
95, 96 Hexagonal opening
97, 98 Cable

The invention claimed is:

1. An electrical connector for releasably connecting a plurality of cable pairs with a conductor cross section of more than 10 $mm^2$, wherein the electrical connector comprises A first electrically insulating housing having chambers and being formed integrally as one single piece;

individual contact elements which are conductively connected to cables of the cable pairs;

wherein said contact elements are plugged into said first housing and wherein said contact elements are latched in and are held replaceably in said first housing due to an elastic deformation of said first housing;

and wherein said first housing is made from a thermoplastic elastomer with a hardness adapted to make it possible for the contact elements to be plugged in and replaced without the aid of tools.

2. The electrical connector as claimed claim 1, wherein the contact elements are arranged in said first housing parallel next to one another in one plane.

3. The electrical connector as claimed in claim 1, wherein three contact elements are arranged next to one another in said first housing.

4. The electrical connector as claimed in claim 1, wherein cable sleeves for accommodating the ends of cables connected to the contact elements are arranged on said first housing, and wherein releasable fastening means are provided, by means of which the cables can be fixed in the cable sleeves.

5. The electrical connector as claimed in claim 4, wherein the cable sleeves taper slightly conically inwards towards the outlet, and wherein the cutouts are likewise slightly conical.

6. The electrical connector as claimed in claim 5, wherein the cable sleeves are split into two sections, which are arranged one behind the other in the plug-in direction, wherein the inner diameter of the section which is positioned further towards the outside is greater than the inner diameter of the other section.

7. The electrical connector as claimed in claim 4, wherein the fastening means each comprise a cable strain-relief clamp, which fixedly clamps the cables in the cable sleeves as a result of external pressure on the cable sleeves.

8. The electrical connector as claimed in claim 7, wherein the cable strain-relief clamps each comprise an upper part and a lower part, which surround the cable sleeves on opposite sides and can be connected to one another.

9. The electrical connector as claimed in claim 7, wherein the cable sleeves are in the form of hollow cylinders which are arranged next to one another parallel at a distance, and wherein the upper part and the lower part of the cable strain-relief clamps are each in the form of a bar, which extends transversely over the cable sleeves and is equipped, on the side facing the cable sleeves, with cutouts so as to conform to the cable sleeves.

10. The electrical connector as claimed in claim 7, wherein the upper and lower parts of the cable strain-relief clamps have mutually aligned bores in order for them to be connected to one another.

11. The electrical connector as claimed in claim 7, wherein the upper and lower parts of the cable strain-relief clamps are connected to one another by means of fastening screws, which extend through the bores, and exert external pressure on the cable sleeves.

12. The electrical connector as claimed in claim 7, wherein the cable strain-relief clamps and therefore the entire electrical connector is fixedly screwed by means of the fastening screws on a base.

13. The electrical connector as claimed in claim 7, wherein the upper part and the lower part of the cable strain-relief clamps are guided with respect to one another by means of guide pins.

14. The electrical connector as claimed in claim 13, wherein the guide pins are coded for the purpose of clear orientation of the parts with respect to one another.

15. The electrical connector as claimed in claim 7, wherein the cable strain-relief clamps are produced from a plastic, in particular a fiber-reinforced polyamide.

16. The electrical connector as claimed in claim 1, further comprising a second electrically insulating housing having chambers and being formed integrally in one piece, each of said housings having connection chambers for receiving the contact elements, wherein in each case one latching tab with a latching groove, which is positioned behind the latter in the plug-in direction, is formed in the connection chambers, and wherein in each case one holding groove and a latching collar are provided on the contact elements so as to interact with a latching tab and latching groove of a respective connection chamber.

17. The electrical connector as claimed in claim 16, wherein each latching collar has a sloping flank on the plug-in side.

18. The electrical connector as claimed in claim 1, further comprising a second electrically insulating housing having chambers and being formed integrally in one piece, and wherein recessed grips for drawing the housings apart from one another are formed on the housings.

19. The electrical connector according to claim 1, wherein said first housing is a socket housing or a plug housing.

20. Use of an electrical connector according to claim 1, for supplying a welding current for welding robots.

21. An arrangement comprising an electrical plug connector and an electrical socket connector, wherein each of the electrical connectors comprises:

an electrically insulating housing having chambers and being formed integrally as one single piece; and individual contact elements which are conductively connected to said cables, wherein: said contact elements are plugged into said housings; said contact elements are latched in and are held replaceably in said housings due to an elastic deformation of said housings; and said housings are made from a thermoplastic elastomer with a hardness adapted to make it possible for the contact elements to be plugged in and replaced without the aid of tools, and further wherein said arrangement further comprises a securing clip that can be inserted into the housings to secure said electrical connectors against being pulled apart from one another when said electrical connectors are connected together.

22. The arrangement as claimed in claim 21, wherein the securing clip comprises an elongate base plate, from which pins protrude in perpendicular fashion in one direction at the ends, and wherein through-bores, into which the securing clip with the pins can be plugged, are provided in the housing.

23. The arrangement as claimed in claim 22, wherein the pins are provided with slots at the free ends and have latching heads, with which they latch in at the outlet of the through-bores.

24. The arrangement as claimed in claim 21, wherein recessed grips are integrally formed on the securing clip, by means of which recessed grips the securing clip can be drawn out of the housings without the use of a tool.

25. The arrangement as claimed in claim 21, wherein slightly conical socket receptacle sections, which are positioned next to one another at a distance and parallel to one another and receive contact sockets of the contact elements of said electrical socket connector, are arranged on said housing of said electrical socket connector, and wherein corresponding ones of contact protection means are arranged on said housing of said electrical plug connector and receive said socket receptacle sections when the electrical connectors have been plugged together.

26. The arrangement as claimed in claim 25, wherein sealing beads are formed on the outside on said socket receptacle sections.

27. The arrangement as claimed in claim 21, further comprising: cable sleeves for accommodating the ends of cables connected to said contact elements of one of said connectors are arranged on said housing of said one of said connectors; releasable fastening means provided on said cable sleeves for fixing cables in said cable sleeves, and wherein: said releasable fastening means comprise at least one cable strain-relief clamp, which fixedly clamps the cables in said cable sleeves as a result of external pressure on the cable sleeves; and mutually fitting coding elements are provided on the strain-relief clamp and on an associated one of said housings and ensure a clear orientation of the strain-relief clamp with respect to the associated housing.

28. The arrangement as claimed in claim 21, wherein the securing clip is designed to be integral and is produced as an injection molded part from a plastic.

29. An electrical connector for releasably connecting a plurality of cable pairs with a conductor cross section of more than 10 $mm^2$, wherein the electrical connector comprises an electrically insulating housing having chambers;

individual contact elements which are conductively connected to said cables;

wherein said contact elements are plugged into said housing and wherein said contact elements are latched in and are held replaceably in said housing due to an elastic deformation of said housing;

and wherein said housing is made from a thermoplastic elastomer and as one single piece.

* * * * *